US005405274A

United States Patent [19]

Cook, III

[11] Patent Number: 5,405,274

[45] Date of Patent: Apr. 11, 1995

[54] TROLLING MOTOR MOUNT CLUTCH SLIP-JOINT

[75] Inventor: Lynn E. Cook, III, Columbus, Miss.

[73] Assignee: Brunswick Corporation

[21] Appl. No.: 72,537

[22] Filed: Jun. 4, 1993

[51] Int. Cl.[6] ..... B63H 5/12

[52] U.S. Cl. ..... 440/6; 440/65

[58] Field of Search ..... 440/49, 53, 57, 64, 440/65, 6, 7

[56] References Cited

U.S. PATENT DOCUMENTS

| | | | |
|---|---|---|---|
| 1,328,313 | 1/1920 | Borchert | 440/65 |
| 1,491,233 | 4/1924 | Harley | 440/65 |
| 2,923,270 | 2/1960 | Travis | 440/64 |
| 2,972,977 | 2/1961 | Havsmann | 440/65 |
| 2,973,738 | 3/1961 | Ladewig | 440/64 |
| 3,240,453 | 3/1966 | Kiekhaefer . | |
| 3,674,228 | 7/1972 | Horton . | |
| 3,839,986 | 10/1974 | Meyer et al. | 440/61 |
| 4,555,233 | 11/1985 | Klammer et al. | 440/65 |
| 4,734,068 | 3/1988 | Edwards . | |
| 5,238,432 | 8/1993 | Renner | 440/65 |

FOREIGN PATENT DOCUMENTS

| | | | |
|---|---|---|---|
| 078791 | 3/1992 | Japan | 440/64 |

*Primary Examiner*—Stephen P. Avila

*Attorney, Agent, or Firm*—Rosenblatt & Associates

[57] ABSTRACT

The present invention prevents damage to the trolling motor and the mount by providing a shock-absorption system capable of lengthening to allow the motor assembly to pivot out of the path of an obstruction. Adjustable friction force maintains the clutch system assembly in its normal operating upright condition. When the trolling motor strikes an underwater object, the clutch friction is overcome and the clutch assembly lengthens, thus assuring that any damage is minimized.

22 Claims, 2 Drawing Sheets

TROLLING MOTOR MOUNT CLUTCH SLIP-JOINT

FIELD OF THE INVENTION

The field of this invention relates generally to mounting structures for outboard motors and more particularly to a clutch slip-joint system that protects the trolling motor from damage when it strikes a submerged object.

BACKGROUND OF THE INVENTION

Trolling motors are generally suspended beneath the surface of water on a mounting structure affixed to the bow or stern of the boat. When trolling, it is not uncommon that a submerged object will be struck by the motor, causing extensive damage to the motor and mounting structure. In the past, various shock-absorption methods have been used to lessen and absorb the energy created by engagement of the motor with the obstacle.

U.S. Pat. No. 3,240,453 illustrates a shock-absorption system adapted for stern-mounted outboard drive motors. The motor is secured to the transom of the boat by swivel, tilt, and clamp brackets on a swivel pin. When the motor strikes an underwater object, the swivel bracket freely tilts out of the path of the object in an upward direction. The gear sector on the swivel bracket engages with the pinion attached to the clamp bracket that is affixed to the boat. Gear sector teeth are adapted to intermesh with corresponding teeth on the pinion, which actuates the clutch. Springs engage the clutch plate and clutch rings to absorb the kinetic energy. Tilting continues forward until the object is cleared, then motion is reversed until the gear segment engages the pinion and clutch system to freefall back to the motor's normal downward operating position. This is a complicated structure and it is exposed so that the gear assembly can jam. Protection is only afforded in one direction.

U.S. Pat. No. 4,734,068 demonstrates a mounting bracket system secured to the bow-mount supporting assembly. When the trolling motor strikes an underwater object, the force created will overcome the force typically maintained by compression springs on thrust pads and pins. The motor support bracket will pivot until the thrust pins reach the ends of the curved arcuate elongated slots on the cam surfaces. Upon release of the force on the compression springs, the thrust pins return to their normal operating position maintained by the compression springs. This design has several shortcomings. It is expensive to make curved slots. The metal-to-metal contact of the moving parts cain, over time and with exposure to saltwater or other corrosive environments, gall and make future movement less likely or impossible. The metal-to-metal contact also can result in paint scraping off, making for an unsightly appearance or promoting rust.

Accordingly, one of the objects of the present invention is to eliminate damage to trolling motors by providing an efficient shock-absorption system that entails easy assembly and carefree maintenance.

SUMMARY OF THE INVENTION

The present invention relates to a slip-joint clutch assembly that is mounted on a fishing trolling motor. When the trolling motor collides with an underwater obstruction, this invention provides a simple, shock-absorbing mechanism that prevents damage to the motor by allowing the motor to swing under the boat. The clutch assembly consists of four principal parts, namely the upper channel, clutch shim, clutch channel, and mechanical fastener. The clutch channel is pivotally connected to the mount bracket. The clutch channel is slidably connected to the upper channel through the clutch shim. Preferably, a bolt is inserted through the spacer and the washers, and is secured by a nut attached to a clamping handle. The clamping handle allows adjustable bolt tension that can be tightened to hold the motor in place under normal operation. When the motor strikes an obstruction, the clutch friction is overcome, and the clutch assembly lengthens through the linear slots in the clutch channel. The motor will stay in this new angulated position under the boat until the clamping handle is turned, releasing the nut and the corresponding clamp force on the channels.

DETAILED DESCRIPTION OF THE PREFERRED EMBODIMENT

Figure 1:
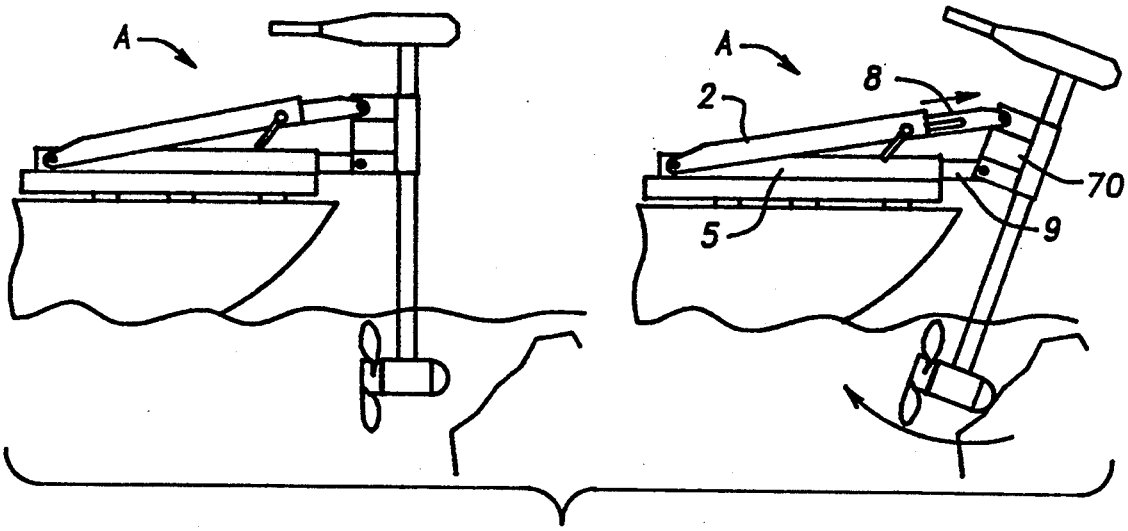
FIG. 1 is a side view showing the present invention in assembly and in use.
Figure 2:
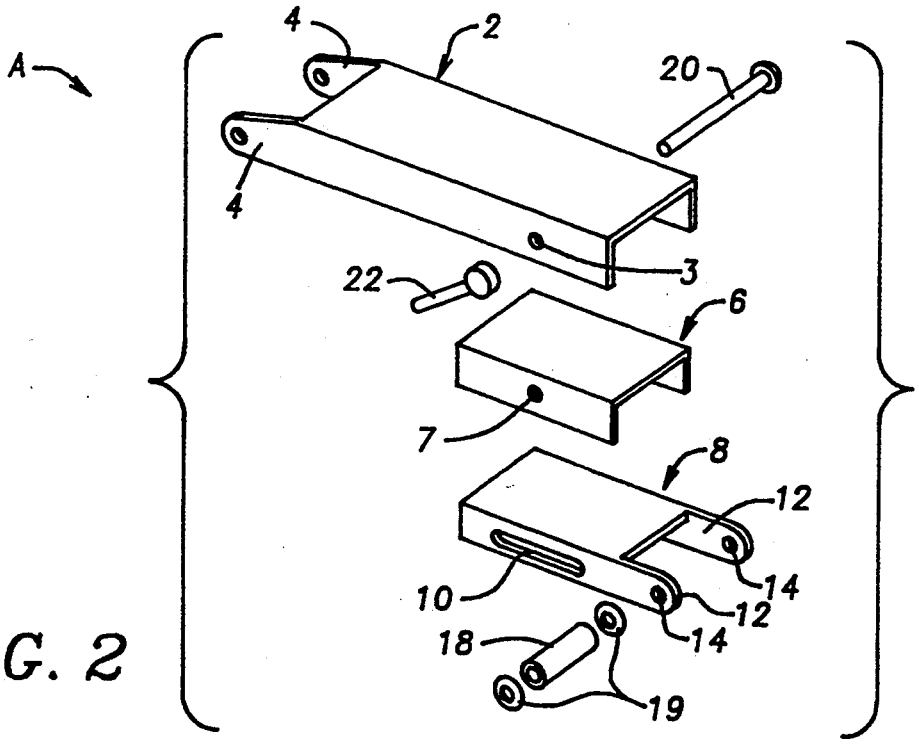
FIG. 2 is an exploded view of the tipper channel, clutch shim, clutch channel, spacer, spacer washers, and bolt.

Apparatus A in FIG. 2 is made of four principal components—an upper channel 2, a clutch shim 6, a clutch channel 8, and a mechanical fastener (preferably a stainless steel bolt 20, two plastic spacer washers 19, and a stainless steel clamping handle 22). While channels are preferred, different shapes can be used without departing from the purview of the invention. The other components are preferably made of aluminum or structural steel. Stainless steel may also be used. Upper channel 2 is a substantially U-shaped conduit with circular passageways 3 near the proximal end of both side panels of tipper channel 2. Two extensions 4 project from the distal end of both side panels of upper channel 2. The extensions are capable of attachment to the deck channel 5 (see FIG. 1).

Clutch shim 6 is substantially U-shaped and is preferably shorter in length than upper channel 2 and clutch channel 8. Clutch shim 6 is sized to be inserted into the underside of upper channel 2 and is further capable of accommodating clutch channel 8 into its underside, such that a selectively locking relationship can be formed. Shim 6 promotes sliding between channel 2 and channel 8, while separating these two channels to prevent galling, and to provide some lubrication to facilitate relative movement between the channels. It is preferably 6/6 nylon. Circular passageways 7 near the proximal end of both side panels on clutch shim 6 are present. Clutch channel 8 is a substantially U-shaped conduit that is longer in length than clutch shim 6 and shorter in length than upper channel 2. An elongated linear slot 10 is centrally located on both side panels of clutch channel 8. Two extensions 12 project from the distal end of clutch channel 8. The extensions 12 are capable of attachment to the upper member of the trolling motor assembly 13 (see FIG. 1) through two circular passageways 14 located at the tips of the two extensions 12.

Figure 3:
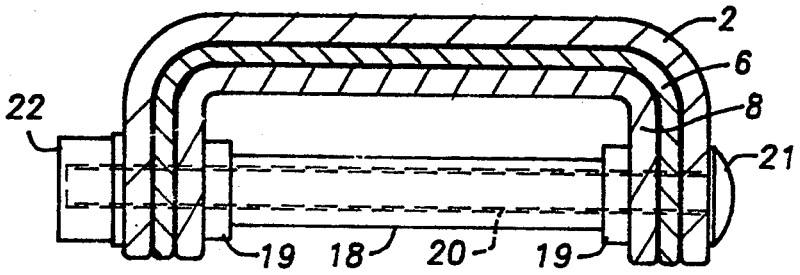
FIG. 3 is a sectional elevational view of the clutch system assembled.

A tubular member 18, capable of maintaining a uniform distance space, is inserted into the underside of clutch channel 8, clutch shim 6, and upper channel 2 while assembled in their selectively locking relationship. Tubular member 18 is fitted with preferably two plastic shoulder washers or flat plastic washers at its ends to ensure that galling and paint scraping do not occur. Channels 2 and 8 and shim 6 are at least partially nested. The circular passageways on upper channel 3, clutch shim 7 passageways, and elongated linear slots 10 are aligned with tubular member 18 and the two washers 19 to accommodate bolt 20, longer in length than the assembled apparatus A (see FIG. 3). The head of bolt 20 and a clamping handle 22, capable of engaging the threaded body of bolt 20, may be tightened in a circular fashion until the desired friction between channels 2 and 8 is achieved on the assembled apparatus.

Under normal operating conditions, the motor assembly is maintained in an upright position by the compression exerted by the clamping handle 22. When the trolling motor assembly strikes an underwater object, kinetic energy is created and the assembled apparatus A absorbs most of the shock. When the clutch frictional forces between channel 2 and shim 6, and channel 8 and shim 6 are overcome, the clutch assembly releases (slips). Clutch channel 8 slides forward on shim 6 via the elongated linear slots 10 to extend the upper member of mount 13 forward, thereby allowing bracket 70 to pivot on bow arm 9 attached to the deck channel 5. Bow arm 9 does not move when clutching. This action, in turn, swings the trolling motor under the boat. Reverse motion is also possible.

Figure 4:
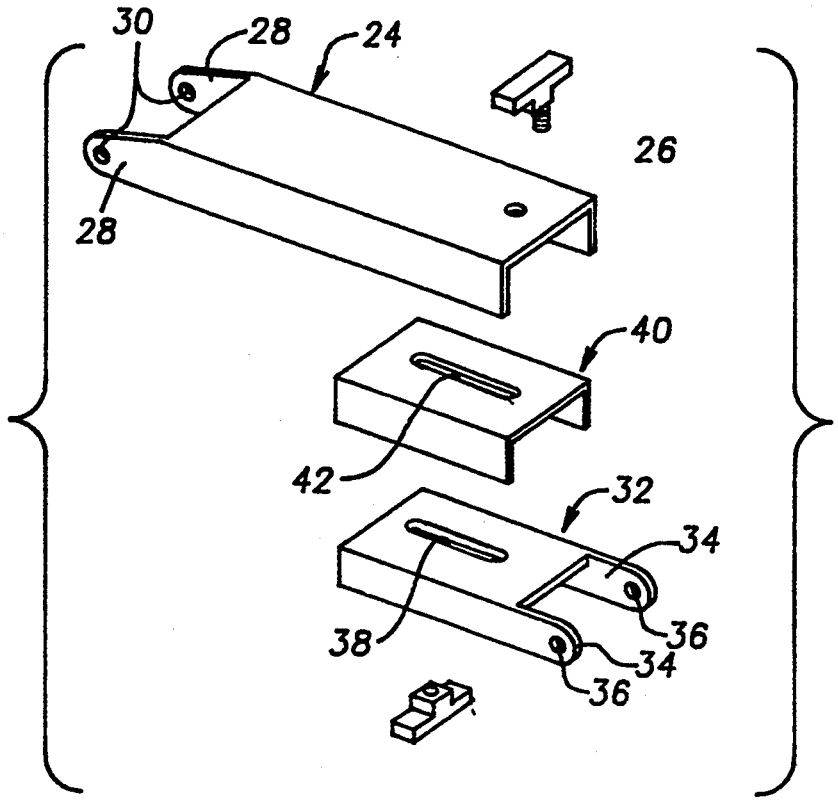
FIG. 4 is an exploded view of an alternative assembly of the upper channel, clutch shim, clutch channel, and bolt.

The clutch assembly could be made to lengthen and/or shorten in a forward or reverse manner using an alternate mechanism (see FIG. 4). Upper channel 24 is substantially a U-shaped conduit that is longer in length than clutch channel 32. The distal end of upper channel 24 has a circular passageway 26 centrally located on the upper panel of upper channel 24. Two extensions 28 with two circular passageways 30 on the side panels of the extensions 28 are located on the proximal end of upper channel 24 and are capable of attachment to deck channel 5.

A clutch channel 32, sized to be inserted into the underside of clutch shim 40, is, in turn, inserted into the underside of upper channel 24. Clutch channel 32 is similarly a substantially U-shaped conduit. When assembled, they are nested at least in part. Two extensions 34 with two circular passageways 36 are capable of attachment to the column support of motor assembly 13. An elongated linear slot 38 is located on the upper panel of clutch channel 32.

Clutch shim 40, preferably 6/6 nylon or rubber or plastic material having high durability and lubricating capabilities, has elongated linear slot 42 similar in size and shape to linear slot 38. Clutch shim 40 is inserted for support into the underside of upper channel 24 and over clutch channel 32 to form a selectively locking relationship with one another. A mechanical fastener bolt and nut may be used to obtain the desired friction to maintain the motor assembly in its normal upright operating condition. When the trolling motor strikes the underwater object, the clutch friction is overcome between channel 32 and shim 40, and clutch channel 32 moves in a forward manner or in a reverse manner, depending on the direction of travel upon impact.

Figure 5:
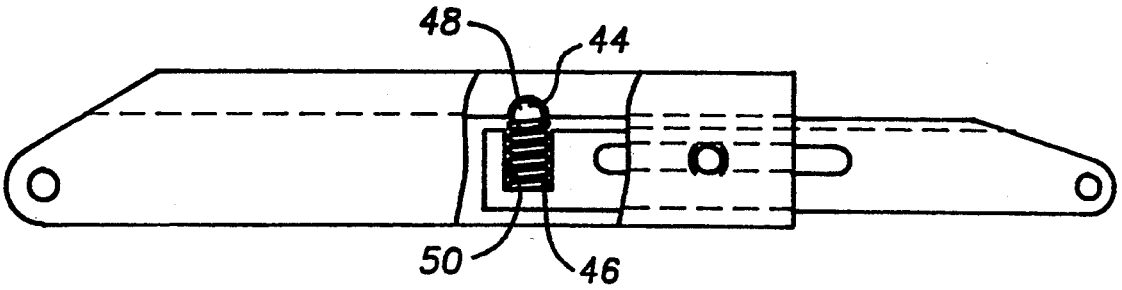
FIG. 5 is a side view of the clutch system assembly with the ball and spring mechanism.

A ball and spring mechanism may be used to locate the clutch system at mid-point of travel to assure that the motor is in the proper upright normal running position (see FIG. 5). A ball 48 and spring 46 slip into a detent 44 to audibly or through sensory communication alert the operator that the motor is in an upright position and that bolt 20 and clamping handle 22 can then be tightened on elongated slots 10, 38, and 42. When the trolling motor strikes the submerged object, the friction on bolt 20 and clamping handle 22 is overcome. Detent 44 is moved in a forward manner due to the clutch action, which compresses ball 48 against spring 46 and into depression housing 50.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for protecting a trolling motor assembly mounted to a boat, comprising:

a base secured to the boat;

a mounting bracket movably mounted to said base at a first position for support of the motor;

a linkage, said linkage connecting a second position on said base to said bracket;

said linkage changing in length in response to a force applied to said bracket to allow said bracket to move from an initial operating position with respect to said base to a subsequent displaced position which is retained after the motor mounted to said bracket strikes an object.

2. The apparatus of claim 1, wherein said linkage further comprises:

a first link;

a second link;

connection means for movably mounting said first to said second link.

3. The apparatus of claim 2, further comprising:

barrier means disposed between said first and second links for substantially isolating contact of said first and said second links.

4. The apparatus of claim 3, wherein:

said first and second link are nested at least in part with said barrier means in between.

5. An apparatus for protecting a trolling motor assembly mounted to a boat, comprising:

a base secured to the boat;

a mounting bracket movably mounted to said base at a first position for support of the motor;

a linkage, said linkage connecting a second position on said base to said bracket;

said linkage changing in length in response to a force applied to said bracket to allow said bracket to move with respect to said base when the motor mounted to said bracket strikes an object;

said clutch means further comprising a fastener connecting said links and said barrier means;

said links formed having aligned unequal openings;

said barrier means formed having an opening;

said fastener extending through said openings in said links and barrier means for selective adjustment of the force resisting relative movement of said links.

6. The apparatus of claim 5, wherein:

said barrier means is formed having an opening aligned with said openings in said first and second links;

said connection means extending through said opening in said barrier means.

7. The apparatus of claim 6, wherein:

said opening in one of said links being elongated to accommodate selective relative sliding movement thereof in opposed directions when the trolling motor strikes an obstruction.

8. The apparatus of claim 7, wherein:

said first and second links and said barrier means comprise nested channel shapes having a web and two flanges, said openings in said links and barrier means extend through said flanges on said links and barrier means;

said connecting means further comprises:

an annular spacer spanning the open web of one of said nested links;

a fastener extending through said openings and said spacer for adjusting the securing force holding one of said links to the other.

9. The apparatus of claim 7, wherein:

said first and second links and said barrier means comprise nested channel shapes;

said openings in said links and barrier means extending through said webs of said links and barrier means;

said connecting means further comprising a fastener extending through said openings for adjusting the securing force holding one of said links to the other.

10. The apparatus of claim 9, wherein:

said barrier means is made of a material that facilitates selective sliding movement between said first and second link.

11. An apparatus for protecting a trolling motor assembly mounted to a boat, comprising:

a base secured to the boat;

a mounting bracket movably connected to said base at a first position for supporting a motor;

a linkage connecting a second position on said base to said mounting bracket, said linkage comprising a plurality of links;

barrier means between said links to substantially separate said links as they move relatively to each other responsive to a force applied to said mounting bracket to allow said bracket to move from an initial operating position with respect to said base to a subsequent displaced position which is retained after the motor mounted to said bracket strikes an object.

12. The apparatus of claim 11, wherein:

said linkage comprises a least two links that move relatively in opposed directions.

13. The apparatus of claim 12, wherein:

said links are nested at least in part with said barrier means in between.

14. An apparatus for protecting a trolling motor assembly mounted to a boat, comprising:

a base secured to the boat;

a mounting bracket movably connected to said base at a first position for supporting a motor;

a linkage connecting a second position on said base to said mounting bracket, said linkage comprising a plurality of links;

barrier means between said links to substantially separate said links as they move relatively to each other responsive to a force applied to said mounting bracket to allow said bracket to move with respect to said base when the motor mounted to said bracket strikes an object;

said linkage comprises a least two links that move relatively in opposed directions;

said links are nested at least in part with said barrier means in between;

said links and barrier means formed having aligned openings;

said opening in one of said links being larger than the opening in another of said links;

a fastener, extending through said openings in said links and said barrier means, for selectively adjusting the force holding one of said links to another;

whereupon when the trolling motor strikes an object in the forward or reverse directions the force applied by said fastener is overcome and one of said links moves with respect to another due to said difference in size of said openings in said links.

15. The apparatus of claim 14, wherein:

said barrier means is made of a material that promotes selective relative movement between said links.

16. A mounting system for a trolling motor on a boat, comprising:

a movably mounted support bracket for the motor, mounted to the boat at a first position;

a linkage connected to a second position on the boat and to said bracket;

said linkage selectively movable responsive to load on said bracket from the motor striking an object;

clutch means on said linkage allowing said linkage to selectively secure said bracket for motor operation and to change length from an operating position to a displaced position and retain said displaced position responsive to load on said bracket from impact between a motor and an object.

17. The system of claim 16, wherein:

said linkage can lengthen or shorten responsive to load on said bracket.

18. The system of claim 17, wherein:

said linkage further comprises:

a plurality of links;

barrier means between said links for facilitating relative movement responsive to loads on said bracket.

19. A mounting system for a trolling motor on a boat, comprising:

a movably mounted support bracket for the motor, mounted to the boat at a first position;

a linkage connected to a second position on the boat and to said bracket;

said linkage selectively movable responsive to load on said bracket from the motor striking an object;

clutch means on said linkage allowing said linkage to selectively secure said bracket for motor operation and to change length responsive to load on said bracket from impact between a motor and an object;

said linkage can lengthen or shorten responsive to load on said bracket;

said linkage further comprises:

a plurality of links;

barrier means between said links for facilitating relative movement responsive to loads on said bracket;

said links mounted in a nested relationship, at least in part;

said barrier means disposed between said nested portions of said links;

said linkage further comprises:

a first link;

a second link;

connection means for movably mounting said first to said second link;

barrier means disposed between said first and second links for substantially isolating contact of said first and said second links;

said first and second link are nested at least in part with said barrier means in between;

said first and second links are formed having aligned openings;

said opening in said first link having a different dimension than said opening in said second link;

said connection means extending through said aligned openings.

20. The system of claim 19, wherein:

said barrier means is made of a material that promotes relative movement between said links.

21. The apparatus of claim 1, further comprising:

indexing means on said linkage for providing feedback as to the position of said linkage which properly orients said mounting bracket for use of the trolling motor.

22. The apparatus of claim 11, further comprising:

indexing means on said linkage for providing feedback as to the position of said linkage which properly orients said mounting bracket for use of the trolling motor.

* * * * *

UNITED STATES PATENT AND TRADEMARK OFFICE

CERTIFICATE OF CORRECTION

PATENT NO. : 5,405,274
DATED : April 11, 1995
INVENTOR(S) : Cook

It is certified that error appears in the above-indentified patent and that said Letters Patent is hereby corrected as shown below:

At claim 5, column 4, lines 61–67, please delete "said clutch means further comprising a fastener connecting said links and said barrier means; said links formed having aligned unequal openings; said barrier means formed having an opening; said fastener extending through said openings in said links and barrier means for selective adjustment of the force resisting relative movement of said links." and insert therefor "-- said linkage further comprises: a first link; a second link; connection means for movably mounting said first to said second link; barrier means disposed between said first and second links for substantially isolating contact of said first and said second links; said first and second link are nested at least in part with said barrier means in between; said first and second links are formed having aligned openings; said opening in said first link having a different dimension than said opening in said second link; said connection means extending through said aligned openings. --"

At claim 19, column 7, lines 1–14 and column 8, lines 1–2, please delete "said linkage further comprises: a first link; a second link; connection means for movably mounting said first to said second link; barrier means disposed between said first and second links for substantially isolating contact of said first and said second links; said first and second link are nested at least in part with said barrier means in between; said first and second links are formed having aligned openings; said opening in said first link having a different dimension than said opening in said second link; said connection means extending through said aligned openings."

UNITED STATES PATENT AND TRADEMARK OFFICE

CERTIFICATE OF CORRECTION

PATENT NO. : 5,405,274

DATED : April 11, 1995

INVENTOR(S) : Cook

It is certified that error appears in the above-indentified patent and that said Letters Patent is hereby corrected as shown below:

and insert therefor " — said clutch means further comprising a fastener connecting said links and said barrier means; said links formed having aligned unequal openings; said barrier means formed having an opening; said fastener extending through said openings in said links and barrier means for selective adjustment of the force resisting relative movement of said links. —"

Signed and Sealed this

Twenty-eighth Day of November 1995

*Attest:*

Bruce Lehman

BRUCE LEHMAN

*Attesting Officer*

*Commissioner of Patents and Trademarks*